US007992687B2

(12) United States Patent
Yumura et al.

(10) Patent No.: US 7,992,687 B2
(45) Date of Patent: Aug. 9, 2011

(54) DEVICE FOR ELEVATOR DOOR CONTROL BASED ON A DETECTED OBJECT

(75) Inventors: Takashi Yumura, Tokyo (JP); Takaharu Ueda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 683 days.

(21) Appl. No.: 12/090,288

(22) PCT Filed: Mar. 20, 2006

(86) PCT No.: PCT/JP2006/305551

§ 371 (c)(1),
(2), (4) Date: Apr. 15, 2008

(87) PCT Pub. No.: WO2007/108089

PCT Pub. Date: Sep. 27, 2007

(65) Prior Publication Data

US 2009/0236185 A1 Sep. 24, 2009

(51) Int. Cl.
*B66B 13/14* (2006.01)

(52) U.S. Cl. ..... 187/316; 187/391

(58) Field of Classification Search ..... 187/247, 187/316, 317, 380–389, 391–393; 49/26, 49/28; 318/280–286, 466–470
See application file for complete search history.

(56) References Cited

U.S. PATENT DOCUMENTS

| | | | | |
|---|---|---|---|---|
| 3,367,450 | A * | 2/1968 | Lester et al. | 187/317 |
| 5,250,765 | A * | 10/1993 | Mizuno et al. | 187/316 |
| 5,274,312 | A * | 12/1993 | Gerstenkorn | 318/617 |
| 5,284,225 | A * | 2/1994 | Platt | 187/316 |
| 5,387,768 | A * | 2/1995 | Izard et al. | 187/392 |
| 5,410,149 | A * | 4/1995 | Winston et al. | 250/221 |
| 5,518,086 | A * | 5/1996 | Tyni | 187/316 |
| 6,962,239 | B2 * | 11/2005 | Shikai et al. | 187/316 |
| 6,973,998 | B2 * | 12/2005 | Deplazes et al. | 187/316 |
| 7,042,492 | B2 * | 5/2006 | Spinelli | 348/143 |
| 7,140,469 | B2 * | 11/2006 | Deplazes et al. | 187/316 |
| 7,165,655 | B2 * | 1/2007 | Cook et al. | 187/316 |

FOREIGN PATENT DOCUMENTS

| | | |
|---|---|---|
| JP | 57 93887 | 6/1982 |
| JP | 61 291386 | 12/1986 |
| JP | 11 278776 | 10/1999 |
| JP | 2000 264561 | 9/2000 |
| JP | 2002 308552 | 10/2002 |
| JP | 2003 252555 | 9/2003 |
| JP | 2003 267651 | 9/2003 |
| JP | 2003 341962 | 12/2003 |
| JP | 2004 338846 | 12/2004 |
| JP | 2005 525277 | 8/2005 |

* cited by examiner

*Primary Examiner* — Jonathan Salata
(74) *Attorney, Agent, or Firm* — Oblon, Spivak, McClelland, Maier & Neustadt, L.L.P.

(57) ABSTRACT

A door device for an elevator is provided with an elevator door for opening/closing a doorway through which an interior of a car communicates with a landing, a distance sensor for continuously detecting a distance from the doorway to a passenger at the landing, a processing device for obtaining a door control command corresponding to information from the distance sensor, and a door control device for controlling a movement of the elevator door based on the door control command from the processing device. Thus, the elevator door can be moved in accordance with the movement of the passenger. Accordingly, the passenger is allowed to board the car more reliably, and a running efficiency of the elevator can be enhanced.

10 Claims, 4 Drawing Sheets

DEVICE FOR ELEVATOR DOOR CONTROL BASED ON A DETECTED OBJECT

TECHNICAL FIELD

The present invention relates to a door device for an elevator, which serves to open/close a doorway through which an interior of a car communicates with a landing.

BACKGROUND ART

Conventionally, with a view to detecting a passenger approaching a doorway of an elevator, there is proposed a door device for an elevator which has a light emitter provided on one of longitudinal frames constituting part of a three-side frame and a light receiver provided on the other longitudinal frame. Light from the light emitter is received by the light receiver. When the passenger blocks light from the light emitter and the light receiver stops receiving the light, the presence of the passenger is thereby detected (see Patent Document 1).

Patent Document 1: JP 2003-341962 A

DISCLOSURE OF THE INVENTION

Problems to be Solved by the Invention

However, the conventional door device for the elevator constructed as described above detects only whether or not there is a passenger passing through the doorway. Therefore, if the range of detection is set exclusively to a range close to the doorway, even when the passenger is moving toward the doorway, the presence of the passenger cannot be detected until the passenger reaches the doorway. As a result, the doorway may be closed. If the range of detection is widened to a range far from the doorway, the doorway remains open for a long time. As a result, the running efficiency of the elevator deteriorates.

The present invention has been made to solve the above-mentioned problems, and it is therefore an object of the present invention to provide a door device for an elevator which allows a passenger to board a car more reliably and makes it possible to enhance the running efficiency of the elevator.

Means for Solving the Problems

A door device for an elevator according to the present invention includes: an elevator door for opening and closing a doorway through which an interior of a car communicates with a landing; a detection device for continuously detecting a movement of a detected object at the landing with respect to the doorway; a processing device for obtaining a door control command corresponding to information from the detection device; and a door control device for controlling a movement of the elevator door based on the door control command.

BEST MODES FOR CARRYING OUT THE INVENTION

Preferred embodiments of the present invention will be described hereinafter with reference to the drawings.

Embodiment 1

Figure 1:
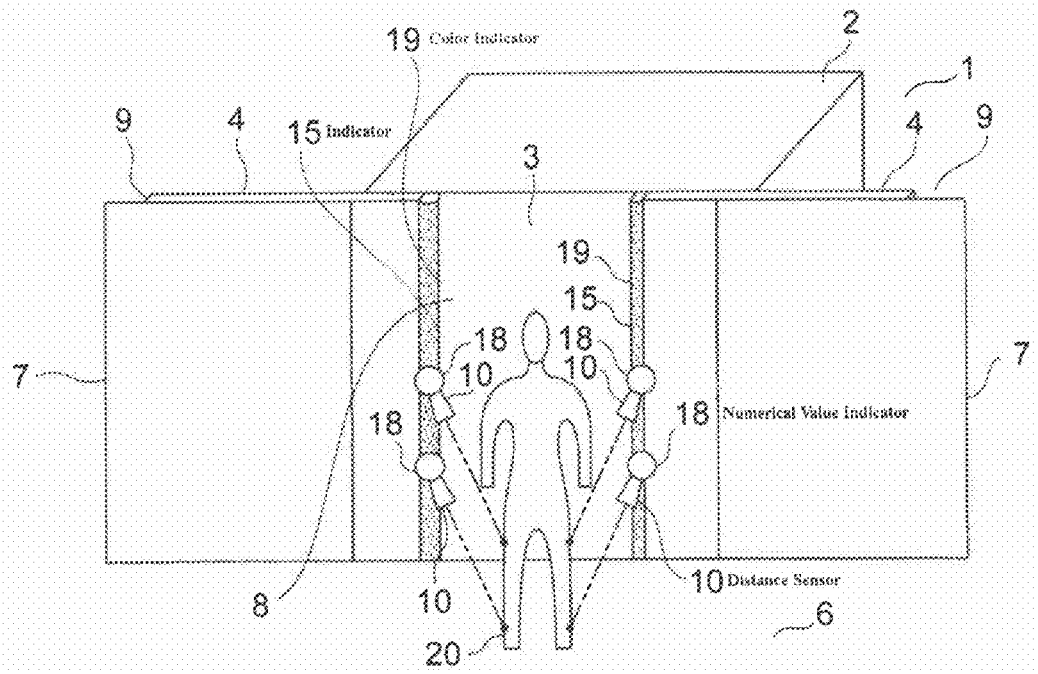
FIG. 1 is a schematic perspective view showing a door device for an elevator according to Embodiment 1 of the present invention.
Figure 2:
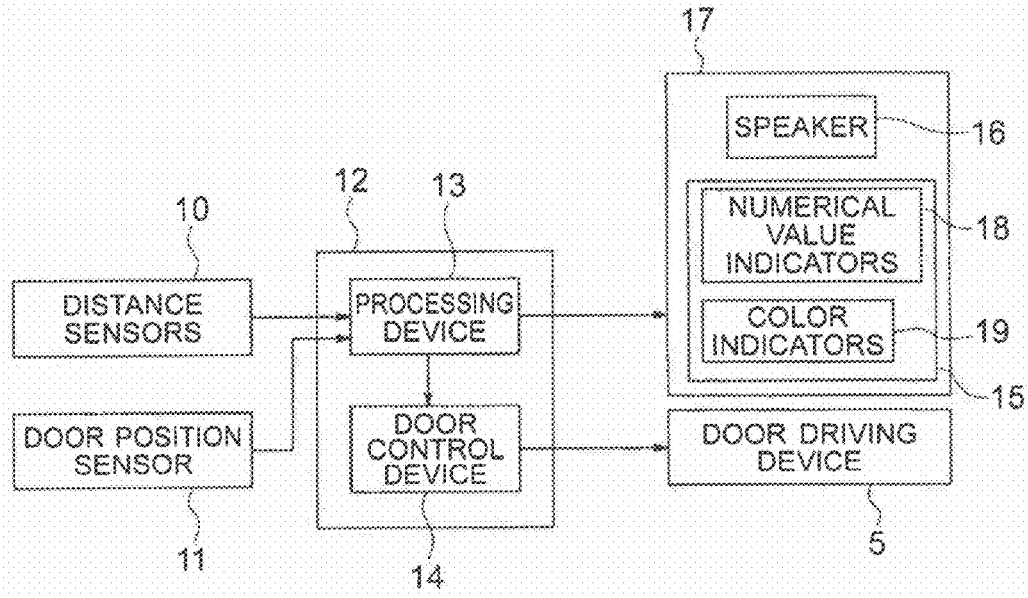
FIG. 2 is a block diagram showing the door device for the elevator shown in FIG. 1.

FIG. 1 is a schematic perspective view showing a door device for an elevator according to Embodiment 1 of the present invention. FIG. 2 is a block diagram showing the door device for the elevator shown in FIG. 1. Referring to FIG. 1, a car 2, which can be raised/lowered within a hoistway 1, is mounted with a pair of car doors 4 for opening/closing a car doorway 3. The car doors 4 are moved in a reciprocating manner in opposite directions along the direction of a frontage of the car doorway 3. The car doorway 3 is opened/closed through reciprocating movements of the car doors 4. The car doors 4 are moved by a door driving device 5 (FIG. 2) mounted on the car 2.

A landing doorway (not shown), which is opened/closed by a pair of landing doors 7, is provided at a landing 6. The landing doors 7 can be engaged with the car doors 4, respectively, through engagement devices (not shown) when the car 2 lands at a landing floor. The landing doors 7 can be moved in a reciprocating manner together with the car doors 4, respectively, through engagement therewith. Thus, the landing doors 7 are moved in a reciprocating manner in the direction of a frontage of the landing doorway. The landing doorway is opened/closed through reciprocating movements of the landing doors 7.

A doorway 8 of the elevator, through which the interior of the car 2 communicates with the landing 6, is constituted by the car doorway 3 and the landing doorway. Elevator doors 9 for opening/closing the doorway 8 of the elevator are constituted by the car doors 4 and the landing doors 7.

Each of the car doors 4 is provided, at a door-closing side end thereof, with a corresponding one of a plurality of distance sensors (detection devices) 10 for continuously detecting a distance from the doorway 8 to a passenger (detected object) 20 at the landing 6. Each of the distance sensors 10 continuously generates a signal corresponding to a distance therefrom to the passenger 20 at the landing 6 (distance information). Thus, the movement of the passenger 20 at the landing 6 with respect to the doorway 8 is continuously detected by the distance sensors 10.

The doorway 8 is provided with a door position sensor 11 for detecting positions of the elevator doors 9 (FIG. 2). The door position sensor 11 continuously generates a signal corresponding to positions of the elevator doors 9 with respect to the doorway 8 (door position information).

Information from the distance sensors 10 and information from the door position sensor 11 are transmitted to a car control panel 12 mounted on the car 2. The car control panel 12 is mounted with a processing device 13 for continuously processing the information from the distance sensors 10 and the information from the door position sensor 11, and a door control device 14 for controlling the movements of the elevator doors 9 based on information from the processing device 13. The control of the movements of the elevator doors 9 by the door control device 14 is performed by controlling the door driving device 5.

The processing device 13 obtains a door control command corresponding to the information from the distance sensors 10. The door control command includes a door-closing possibility command indicating whether or not a door-closing operation of the elevator doors 9 can be performed, and a door-closing speed command indicating a moving speed of the elevator doors 9 during the door-closing operation thereof. The door control device 14 controls the movements of the elevator doors 9 based on the door control command.

More specifically, the processing device 13 calculates, as a boarding predictive index, a probability of the passenger 20 at the landing 6 boarding the car 2 based on the information from the distance sensors 10, compares the calculated boarding predictive index with a preset threshold to determine whether or not the door-closing operation of the elevator doors 9 can be performed, and obtains a result of the determination as a door-closing possibility command. That is, when the boarding predictive index is equal to or higher than the threshold, the processing device 13 determines that the door-closing operation of the elevator doors 9 cannot be performed (makes a negative determination on door-closing possibility). When the boarding predictive index becomes lower than the threshold, the processing device 13 determines that the door-closing operation of the elevator doors 9 can be performed (makes a positive determination on door-closing possibility). In the case where a negative determination on door-closing possibility continues, the processing device 13 makes a positive determination on door-closing possibility when the passenger 20 finishes boarding the car 2.

In this example, the determination on the possibility of the door-closing operation of the elevator doors 9 is made according to an expression (1).

$$((W1\cdot V)/(W2\cdot L))<A \quad (1)$$

In the expression (1), V denotes a moving speed of the passenger 20, L denotes a distance from the doorway 8 to the passenger 20, and A denotes a threshold. Further, W1 denotes a weighting factor regarding the speed V, and W2 denotes a weighting factor regarding the distance L. The speed V is obtained by calculating changes in the distance L with time.

The boarding predictive index is indicated by a left-hand side of the expression (1). That is, the boarding predictive index decreases as the distance L increases and as the speed V decreases. For example, even in the case where the position of the passenger 20 is far from the doorway 8, the boarding predictive index is high when the speed V of the passenger 20 moving toward the doorway 8 is high. On the other hand, even in the case where the position of the passenger 20 is close to the doorway 8, the boarding predictive index is low when the passenger 20 moves away from the doorway 8.

When a positive determination on door-closing possibility is made, the processing device 13 calculates a moving speed of the elevator doors 9 during the door-closing operation thereof, and obtains a result of the calculation as a door-closing speed command. The door-closing speed command is obtained based on the boarding predictive index.

In this example, the moving speed of the elevator doors 9 during the door-closing operation thereof is calculated according to an expression (2).

$$W0\cdot(A-W3\cdot V)/(W4\cdot L))=Dv \quad (2)$$

In the expression (2), Dv denotes a moving speed of the elevator doors 9 during the door-closing operation thereof. Further, W3 denotes a weighting factor regarding the speed V, and W4 denotes a weighting factor regarding the distance L. Still further, W0 denotes a factor for relating (A−(W3·V)/(W4·L)) and Dv to each other.

Accordingly, the moving speed Dv of the elevator doors 9 during the door-closing operation thereof decreases as the boarding predictive index increases, as is apparent from the expression (2).

The processing device 13 continuously processes the information from the distance sensors 10 and the information from the door position sensor 11 to calculate, as a boarding inhibitory index, a probability of the passenger 20 being inhibited from boarding the car 2 by the door-closing operation of the elevator doors 9. For example, even in the case where the passenger 20 is far from the doorway 8, when the door-open dimension of the doorway 8 is large, the passenger 20 is unlikely to be inhibited from boarding the car 2, so the boarding inhibitory index is low. On the other hand, even in the case where the position of the passenger 20 is close to the door way 8, when the door-closing operation of the elevator doors 9 is about to be completed, the passenger 20 is likely to be inhibited from boarding the car 2, so the boarding inhibitory index is high.

Information on the boarding inhibitory index calculated by the processing device 13 is continuously reported to the passenger 20 by a reporting device 17. The reporting device 17 has indicators 15 that change visually in accordance with the boarding inhibitory index, and a speaker 16 for generating a sound corresponding to the boarding inhibitory index. The indicators 15 have a plurality of numerical value indicators 18 for indicating a numerical value corresponding to the boarding inhibitory index, and a pair of color indicators 19 for indicating a color corresponding to the boarding inhibitory index.

The numerical value indicators 18 are provided on the distance sensors 10, respectively. The color indicators 19 are rod-shaped lighting elements (e.g., LED's), each of which is disposed along a height direction of a corresponding one of the car doors 4. The color indicators 19 change the type of color (e.g., blue, yellow, or red) and the depth thereof to indicate the information on the boarding inhibitory index.

The speaker 16 changes the tone of a sound, the intensity thereof, and the timing of emission thereof to transmit the information on the boarding inhibitory index to the passenger 20. Further, the speaker 16 announces information on a door control command (e.g., "The door is closing").

Figure 3:
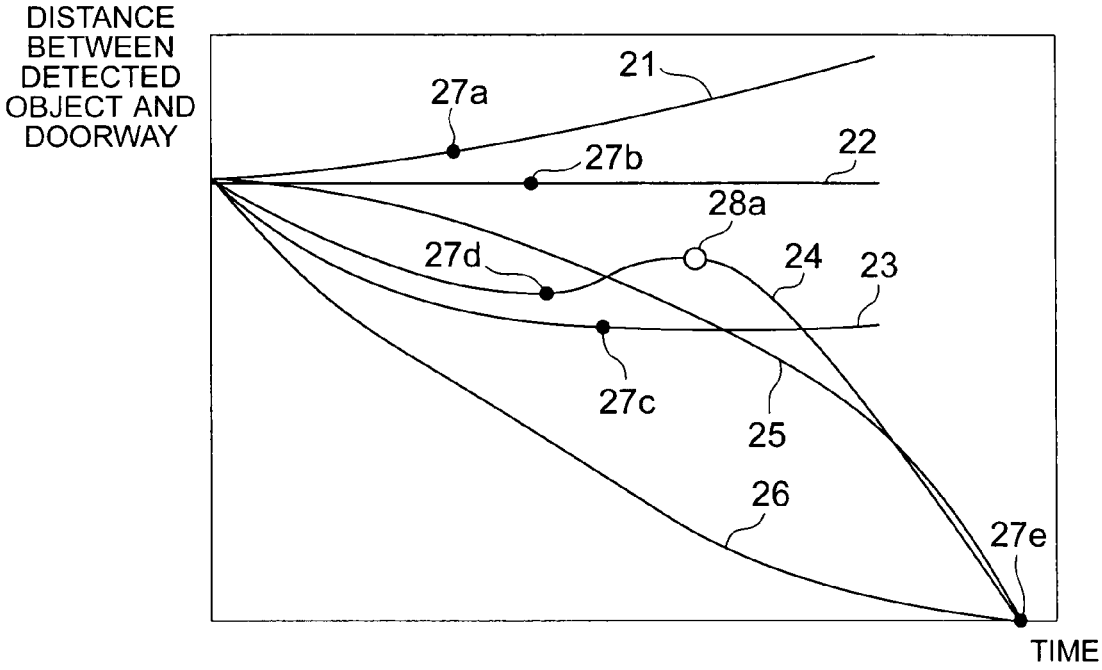
FIG. 3 is a graph showing how the distance from a doorway to a passenger of FIG. 1 is related to time.

FIG. 3 is a graph showing how the distance L from the doorway 8 to the passenger 20 of FIG. 1 is related to time. FIG. 3 shows how the distance L is related to time as to six cases, namely, a case where the passenger 20 moves away from the doorway 8 (solid line 21), a case where the passenger 20 stands still (solid line 22), a case where the speed of the passenger 20 moving toward the doorway 8 becomes extremely low (solid line 23), a case where the passenger 20 moving toward the doorway 8 once turns back and then moves toward the doorway 8 again (solid line 24), and two cases where the passenger 20 continuously approaches the doorway 8 before finishing boarding the car 2 (solid line 25 and solid line 26).

As shown in FIG. 3, in the case of the solid line 21, the passenger 20 continuously moves away from the doorway 8, so the boarding predictive index drops below the threshold at an early stage. Accordingly, the processing device 13 makes a positive determination on door-closing possibility at an early stage, so the door-closing operation of the elevator doors 9 is started at a point 27*a*.

In the case of the solid line 23, the passenger 20 keeps moving toward the doorway 8 for a certain duration of time, so the boarding predictive index drops below the threshold later than in the case of the solid line 21. Accordingly, the processing device 13 makes a positive determination on door-closing possibility later than in the case of the solid line 21. As a result, the door-closing operation of the elevator doors 9 is started at a point 27*c*, which is retarded with respect to the point 27*a*.

In the case of the solid line 22, the boarding predictive index drops below the threshold somewhere between time points in the cases of the solid line 21 and the solid line 23. As a result, the door-closing operation of the elevator doors 9 is started at a point 27*b*, which is retarded with respect to the point 27*a* and advanced with respect to the point 27*c*.

In the cases of the solid lines 21 to 23, the moving speed Dv of the elevator doors 9 during the door-closing operation thereof decreases in the ascending order of the boarding predictive index, namely, in the order of the cases of the solid line 21, the solid line 22, and the solid line 23.

In the case of the solid line 24, the passenger 20 once turns back and then approaches the doorway 8 again, so the boarding predictive index once drops below the threshold and then exceeds the threshold again. Accordingly, in this case, the door-closing operation of the elevator doors 9 is once started at a point 27*d*, and the movement of the elevator doors 9 is stopped when the boarding predictive index exceeds the threshold. After that, the door-closing operation of the elevator doors 9 is resumed when the passenger 20 finishes boarding the car 2.

In each of the cases of the solid lines 25 and 26, the passenger 20 continuously approaches the doorway 8, so the door-closing operation of the elevator doors 9 is not started until the passenger 20 finishes boarding the car 2. In each of those cases, the door-closing operation of the elevator doors 9 is started at a point 27*e* where the passenger 20 finishes boarding the car 2.

Figure 4:
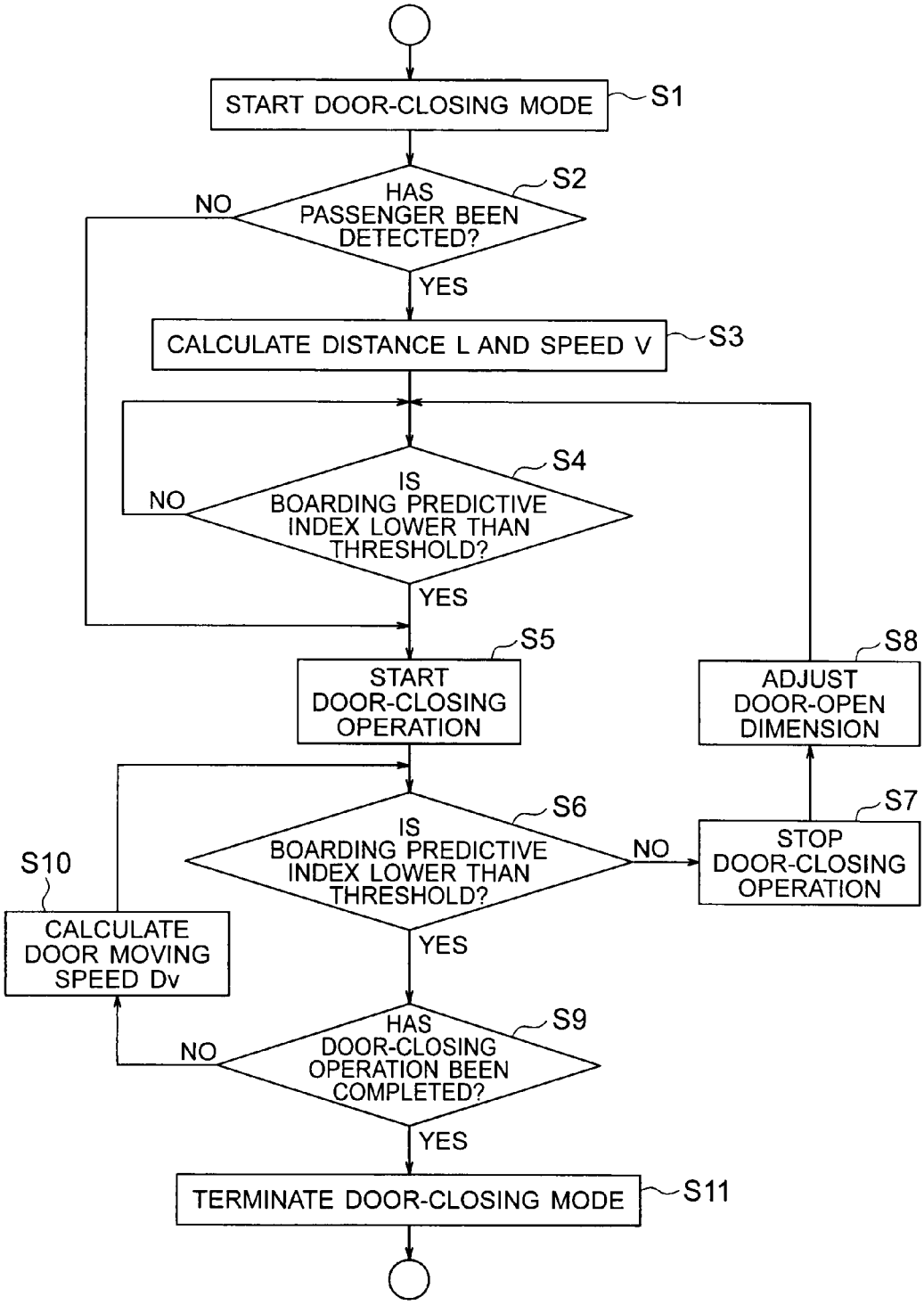
FIG. 4 is a flowchart for explaining the operation of a processing device of FIG. 1.

Next, the operation of the processing device 13 will be described. FIG. 4 is a flowchart for explaining the operation of the processing device 13 of FIG. 1. As shown in FIG. 4, when the door-opening operation of the elevator doors 9 is completed, a door-closing mode for performing the door-closing operation of the elevator doors 9 is started (S1). When the door-closing mode is started, the processing device 13 determines whether or not the distance sensors 10 have detected the passenger 20 (S2).

In a case where the distance sensors 10 have detected the passenger 20, the processing device 13 calculates the distance L from the doorway 8 to the passenger 20 and the speed V of the passenger 20 based on information from the distance sensors 10 (S3). After that, the processing device 13 assigns the distance L and the speed V to the expression (1) to determine whether or not the boarding predictive index is lower than the threshold (S4). When the boarding predictive index is lower than the threshold, the processing device 13 repeatedly determines whether or not the boarding predictive index is lower than the threshold until the boarding predictive index becomes equal to or higher than the threshold.

On the other hand, in a case where the distance sensors 10 have not detected the passenger 20 or in a case where the boarding predictive index has become lower than the threshold, the processing device 13 makes a positive determination on door-closing possibility to start the door-closing operation of the elevator doors 9 (S5). After that as well, the processing device 13 continues to determine whether or not the boarding predictive index is lower than the threshold (S6).

For example, when the boarding predictive index becomes equal to or higher than the threshold again during the movement of the elevator doors 9 as in the case of the solid line 24 of FIG. 3, the processing device 13 makes a negative determination on door-closing possibility to stop the movement of the elevator doors 9 (S7). After that, the processing device 13 causes the door control device 14 to adjust the positions of the elevator doors 9 such that the doorway 8 has a door-open dimension corresponding to the number of passengers 20 detected based on the information from the distance sensors 10 (S8). After that, the processing device 13 determines whether or not the boarding predictive index is lower than the threshold (S4), and performs the same processings as described above again.

When the elevator doors 9 continue to move while the boarding predictive index remains lower than the threshold, the processing device 13 determines whether or not the door-closing operation of the elevator doors 9 has been completed (S9). In a case where the door-closing operation has not been completed, the processing device 13 assigns the distance L and the speed V to the expression (2) to calculate the moving speed Dv of the elevator doors 9 (S10), and causes the elevator doors 9 to move at the calculated speed Dv. After that, the processing device 13 determines whether or not the boarding predictive index is lower than the threshold (S6), and performs the same processings as described above again. Thus, the moving speed Dv of the elevator doors 9 changes based on the boarding predictive index until the door-closing operation is completed. After that, when the door-closing operation is completed, the door-closing mode is terminated (S11).

Next, the operation of the reporting device 17 in the door-closing mode will be described. When the door-closing mode is started, the speaker 16 announces that the door-closing mode has been established. After that, when the passenger 20 is detected by the distance sensors 10, the reporting device 17 continuously reports to the passenger 20 information on the boarding inhibitory index calculated by the processing device 13, until the door-closing operation of the elevator doors 9 is completed.

For example, when the passenger 20 is detected by the distance sensors 10, the color indicators 19 emit blue light. After that, when the boarding inhibitory index increases as the timing for starting the door-closing operation of the elevator doors 9 draws near, the depth of blue decreases continuously. After that, when the door-closing operations of the elevator 9 is started, the color of the color indicators 19 changes from blue to yellow. After that, when the boarding inhibitory index further increases due to the door-closing operation of the elevator doors 9, the color of the color indicators 19 starts changing from yellow to red. When the door-open dimension of the doorway 8 becomes equal to or smaller than a predetermined value, the color of the color indicators 19 turns red completely.

The numerical value indicated by each of the numerical value indicators 18 also changes as the boarding inhibitory index changes. The tone of a sound emitted from the speaker 16, the intensity thereof, and the timing of emission thereof also change as the boarding inhibitory index changes. Further, the speaker 16 emits sounds regarding information on the timing for starting the door-closing operation of the elevator doors 9, the moving speed of the elevator doors 9 during the door-closing operation thereof, the boarding predictive index, and the like, based on information from the processing device 13.

In the door device for the elevator constructed as described above, the distance from the doorway 8 to the passenger 20 is continuously detected by the distance sensors 10, and the information from the distance sensors 10 is continuously processed to control the movements of the elevator doors 9, so the movements of the elevator doors 9 can be made to reflect the movement of the passenger 20 continuously. Thus, the elevator doors 9 can be caused to make movements corresponding to the passenger 20 as well as simple movements such as inversion and stop, so the passenger 20 is allowed to board the car 2 more smoothly and more reliably. Further, when the passenger 20 is in a certain state, the door-closing operation of the elevator doors 9 can be started before the passenger 20 finishes boarding the car 2, so the running efficiency of the elevator can be enhanced as well.

The probability of the passenger 20 boarding the car 2 is calculated as the boarding predictive index, and this boarding predictive index is compared with the preset threshold to determine whether or not the door-closing operation of the elevator doors 9 can be performed. Therefore, even in the case where the passenger 20 has been detected by the distance sensors 10, it is possible to determine whether or not the passenger 20 boards the car 2. Thus, it is possible to determine at an early stage whether or not the passenger 20 boards the car 2, so the running efficiency of the elevator can further be enhanced.

The probability of the passenger 20 boarding the car 2 is calculated as the boarding predictive index, and the moving speed of the elevator doors 9 during the door-closing operation thereof is adjusted based on the boarding predictive index. Therefore, the moving speed of the elevator doors 9 can be reduced when the passenger 20 is likely to board the car 2, so the passenger 20 is allowed to board the car 2 more reliably. The moving speed of the elevator doors 9 can be increased when the passenger 20 is unlikely to board the car 2, so the running efficiency of the elevator can further be enhanced as well.

The probability of the passenger 20 being inhibited from boarding the car 2 by the door-closing operation of the elevator doors 9 is calculated by the processing device 13 as the boarding inhibitory index, and the information on the boarding inhibitory index is transmitted to the passenger 20 by the reporting device 17, so the passenger 20 can determine whether or not he/she can board the car 2. Thus, the passenger 20 is allowed to board the car 2 more reliably. Further, the frequency with which the passenger 20 makes a forceful attempt to board the car 2 can be lowered, so the frequency with which the inversion operation of the elevator doors 9 is performed can be lowered. As a result, the running efficiency of the elevator can be enhanced as well.

The numerical value corresponding to the boarding inhibitory index is continuously indicated by each of the numerical value indicators 18, and the color corresponding to the boarding inhibitory index is continuously indicated by each of the color indicators 19, so changes in the probability of the passenger 20 being allowed to board the car 2 are easily understandable. Accordingly, the passenger 20 can be given a sense of reassurance.

The elevator doors 9 are provided with the plurality of distance sensors 10, so the moving direction of the passenger 20 can be detected more reliably based on the information detected individually by the distance sensors 10. Accordingly, the processing device 13 can be caused to perform a processing of making the boarding predictive index lower than the threshold or the like when, for example, the passenger 20 moves parallel to the direction of the frontage of the doorway 8. As a result, the elevator doors 9 can be prevented from malfunctioning.

In the foregoing example, the elevator doors 9 move in synchronization with each other. However, the elevator doors 9 may be moved individually under the control performed by the door control device 14. In this manner, the elevator doors 9 can be controlled in more detail in accordance with the movement of the passenger 20. For example, when the passenger 20 approaches the doorway 8 from the right side, it is possible to perform control of reducing the moving speed of only the elevator door 9 on the right side or the like. Accordingly, the passenger 20 is allowed to board the car 2 more smoothly, and the running efficiency of the elevator can further be enhanced.

In the foregoing example, the numerical value indicators 18 and the color indicators 19 change visually in accordance with common information. However, the numerical value indicators 18 and the color indicators 19 may change visually in an individual manner in accordance with different pieces of information. In this case, the processing device 13 transmits pieces of information corresponding to signals, which are output from the distance sensors 10, to the numerical value indicators 18 and the color indicators 19 individually. In this manner, the information corresponding to the movement of the passenger 20 can be reported to the passenger 20 in more detail. For example, when the passenger 20 approaches the doorway 8 from the right side, only those of the numerical value indicators 18 and the color indicators 19 which are provided on the elevator door 9 on the right side can be changed visually. Thus, the indicators 15 can report to the passenger 20 that the elevator has detected the movement of the passenger 20. Accordingly, the passenger 20 can be given a sense of reassurance and is allowed to board the car 2 more smoothly.

In the foregoing example, the distance sensors 10 are employed as the detection devices for continuously detecting the movement of the passenger 20 with respect to the doorway 8. However, the present invention is not limited to this construction. For example, imaging cameras for continuously photographing the movement of the passenger 20, luminosity sensors for continuously measuring the luminosity (degree of brightness) that changes in accordance with the movement of the passenger 20, sound collecting microphones for continuously measuring the intensity of a sound generated through the movement of the passenger 20 (e.g., footsteps of the passenger 20) or the like may be employed as the detection devices. In this manner as well, the information detected by the detection devices changes in accordance with the movement of the passenger 20 with respect to the doorway 8, so the elevator doors 9 can be caused to make movements corresponding to the movement of the passenger 20.

Embodiment 2

Figure 5:
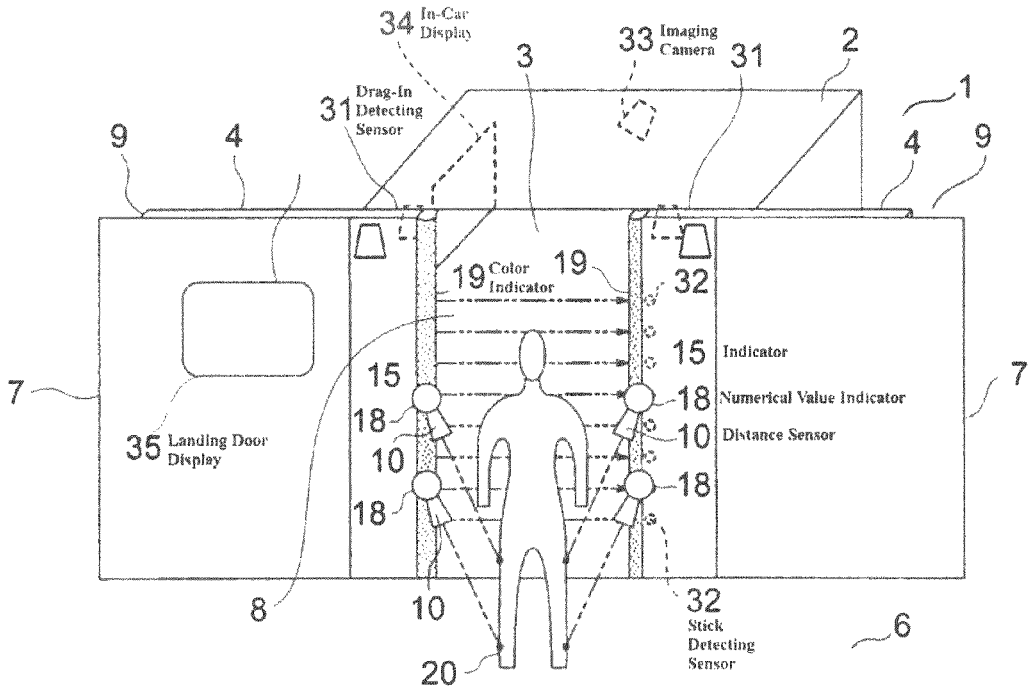
FIG. 5 is a schematic perspective view showing a door device for an elevator according to Embodiment 2 of the present invention.
Figure 6:
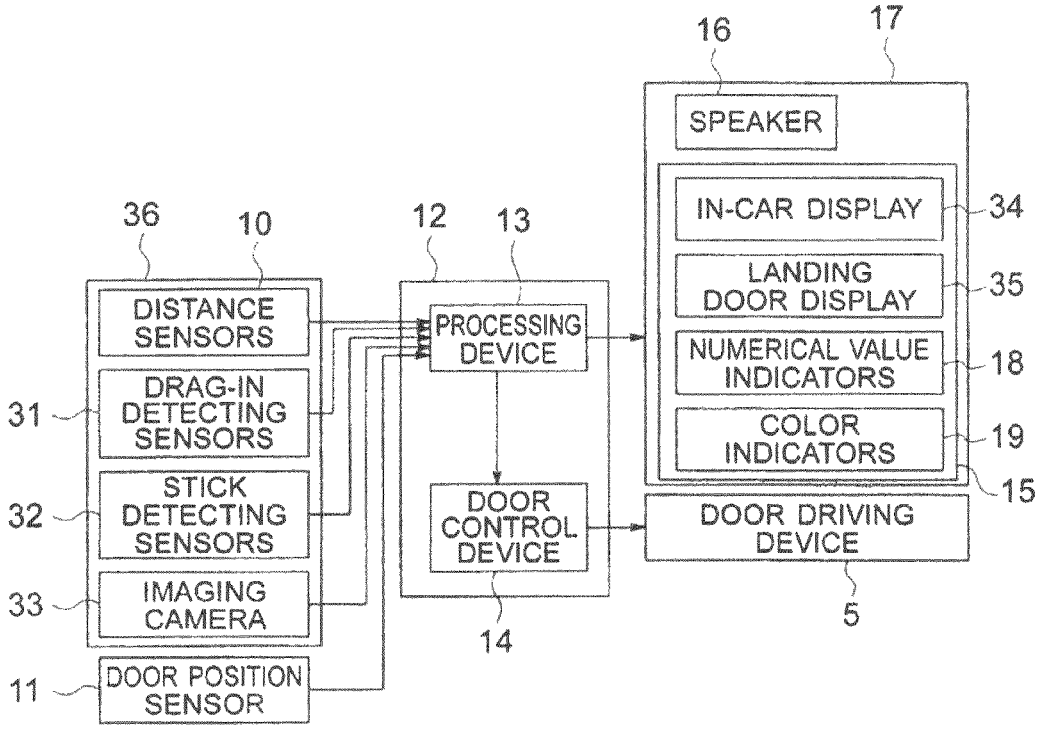
FIG. 6 is a block diagram showing the door device for the elevator shown in FIG. 5.

FIG. 5 is a schematic perspective view showing a door device for an elevator according to Embodiment 2 of the present invention. FIG. 6 is a block diagram showing the door device for the elevator shown in FIG. 5. Referring to FIG. 5, door pockets, in which the elevator doors 9 are accommodated, respectively, upon completion of a door-opening operation thereof, are provided at both ends of the doorway 8 in the direction of the frontage thereof. Drag-in detecting sensors 31, whose detection ranges for detecting the passenger 20 are set within the door pockets, are provided above the door pockets. Each of the drag-in detecting sensors 31 detects whether or not, for example, one of the hands or part of the clothes of the passenger 20 has been dragged into a corresponding one of the door pockets. That is, when one of the hands of the passenger 20, part of the clothes of the passenger 20, or the like is dragged into one of the door pockets, the hand of the passenger 20, the part of the clothes of the passenger 20, or the like falls within the detection range of a corresponding one of the drag-in detecting sensors 31. As a result, the dragging of the passenger 20 into the door pocket is detected.

Stick detecting sensors 32, whose detection ranges for detecting the passenger 20 are set within a space between the elevator doors 9, are provided at door-closing side ends of the elevator doors 9. Each of the stick detecting sensors 32 detects whether or not the passenger 20, a piece of baggage, or the like has entered the space between the elevator doors 9. That is, when the passenger 20, the piece of baggage, or the like passes through the space between the elevator doors 9, the detection range of each of the stick detecting sensors 32 includes the passenger 20, the piece of baggage, or the like. As a result, the ingress of the passenger 20, the piece of baggage, or the like into the space between the elevator doors 9 is detected.

The stick detecting sensors 32 have a plurality of light emitters provided on one of the elevator doors 9, and a plurality of light receivers provided on the other elevator door 9 to receive light from the light emitters. Depending on whether or not each of the light receivers receives light from a corresponding one of the light emitters, it is detected whether or not there is a detected object entering the space between the elevator doors 9.

An imaging camera (imaging sensor) 33, whose detection range for detecting the passenger 20 is set within the car 2 and at the doorway 8, is provided in the car 2. The imaging camera 33 detects the state of the passenger 20 within the car 2 and at the doorway 8. The state of the passenger 20 is detected by subjecting information from the imaging camera 33 to an image processing. The dragging of the passenger 20 into one of the door pockets or the ingress of the passenger 20 into the space between the elevator doors 9 can also be detected by the imaging camera 33. That is, the detection range of the imaging camera 33 overlaps with the detection range of each of the drag-in detecting sensors 31 and the detection range of each of the stick detecting sensors 32.

The detection range of each of the distance sensors 10 is set at the landing 6.

That is, the detection ranges of the distance sensors 10, the drag-in detecting sensors 31, the stick detecting sensors 32, and the imaging camera 33 are individually set between the interior of the car 2 and the landing 6. A detection device 36 for detecting the state of the passenger 20 has the distance sensors 10, the drag-in detecting sensors 31, the stick detecting sensors 32, and the imaging camera 33.

Information from the distance sensors 10, information from the door position sensor 11, information from the drag-in detecting sensors 31, information from the stick detecting sensors 32, and information from the imaging camera 33 are continuously transmitted to the processing device 13. The processing device 13 continuously processes the information from the distance sensors 10, the information from the door position sensor 11, the information from the drag-in detecting sensors 31, the information from the stick detecting sensors 32, and the information from the imaging camera 33.

The processing device 13 obtains a door control command corresponding to the state of the passenger 20 based on information from the detection device 36. The door control device 14 controls the movements of the elevator doors 9 based on the door control command from the processing device 13. For example, in a case where the dragging of the passenger 20 into one of the door pockets has been detected by the detection device 36, the door-closing operation of the elevator doors 9 is performed. In a case where the ingress of the passenger 20 into the space between the elevator doors 9 has been detected by the detection device 36, the door-opening operation of the elevator doors 9 is performed.

The processing device 13 also compares pieces of information from the sensors, namely, the distance sensors 10, the drag-in detecting sensors 31, the stick detecting sensors 32, and the imaging camera 33 with one another to determine whether or not each of the sensors makes an error in detection, and obtains a door control command based on a result of the determination. For example, in a case where the sticking of the passenger 20 between the elevator doors 9 has been detected by the stick detecting sensors 32 but the passenger 20 has not been detected in an image obtained from the imaging camera 33, the processing device 13 determines that one of the stick detecting sensors 32 has made an error in detection, and obtains a door control command on the assumption that the stick detecting sensors 32 have not detected the sticking of the passenger 20 between the elevator doors 9.

Each of the distance sensors 10, the drag-in detecting sensors 31, the stick detecting sensors 32, and the imaging camera 33 is provided with a sensor information indicator (not shown). Each of the sensor information indicators individually indicates whether or not a corresponding one of the sensors is in detecting operation. When at least one of the distance sensors 10, the drag-in detecting sensors 31, the stick detecting sensors 32, and the imaging camera 33 detects the passenger 20, only the sensor information indicator provided on that one of the sensors which has detected the passenger 20 changes visually by, for example, emitting light. Thus, detecting sensor information for identifying that one of the sensors which has detected the passenger 20 is reported to the passenger 20.

An in-car display 34 for reporting information from the processing device 13 to the passenger 20 within the car 2 is provided within the car 2. One of the landing doors 7 is provided with a landing door display 35 for reporting the information from the processing device 13 to the passenger 20 at the landing 6. Each of the in-car display 34 and the landing door display 35 displays the information from the processing device 13 as an image.

The information transmitted from the processing device 13 to the in-car display 34 and the landing door display 35 includes image information from the imaging camera 33, information on a door control command, information on a boarding inhibitory index, and detecting sensor information.

A sensor information reporting device for reporting the detecting sensor information to the passenger 20 has the sensor information indicators, the in-car display 34, and the landing door display 35. Embodiment 2 of the present invention is identical to Embodiment 1 of the present invention in other constructional details.

In the door device for the elevator constructed as described above, the movements of the elevator doors 9 are controlled based on the pieces of information from the plurality of sensors 10 and 31 to 33, whose detection ranges for detecting the passenger 20 are individually set between the interior of the car 2 and the landing 6. Therefore, the elevator doors 9 can be moved in accordance with the state of the passenger 20. Thus, the state of the passenger 20 can be reflected by the movements of the elevator doors 9 more in detail, so the passenger 20 is allowed to board the car 2 more smoothly and more reliably. When the passenger 20 is in a certain state, the door-closing operation of the elevator doors 9 can be started before the passenger 20 finishes boarding the car 2. Therefore, the running efficiency of the elevator can be enhanced as well.

The detecting sensor information for identifying that one of the sensors which has detected the passenger 20 is reported to the passenger 20 by the sensor information reporting device. Therefore, the passenger 20 can recognize which one of the sensors has detected him/her.

The sensors 10 and 31 to 33 are provided with the sensor information indicators, and only the sensor information indicator provided on that one of the sensors which has detected the passenger 20 changes visually. Therefore, the detecting sensor information can be reported to the passenger 20 with a simple construction.

The detection range of the imaging camera 33 overlaps with the detection range of each of the drag-in detecting sensors 31 and the detection range of each of the stick detecting sensors 32, and the information from the imaging camera 33 is compared with the information from the drag-in detecting sensors 31 and the information from the stick detecting sensors 32 to determine whether or not the detection device 36 has made an error in detection. Therefore, the reliability of the detecting operation of the detection device 36 can be enhanced. Thus, the elevator doors 9 can be prevented from malfunctioning, so the safety of the passenger 20 can be improved.

In the foregoing example, the sensor information indicators, the in-car display 34, and the landing door display 35 display the detecting sensor information. However, a sound regarding the detecting sensor information may be emitted from the speaker 16 to report the detecting sensor information to the passenger 20. A sound regarding the door control command may also be emitted from the speaker 16. For example, when one of the stick detecting sensors 32 detects the passenger 20, a sound indicating that the stick detecting sensor 32 has detected the passenger 20 and a sound indicating that the elevator doors 9 are to be inverted from the door-closing operation to the door-opening operation may be emitted from the speaker 16.

In each of the foregoing embodiments of the present invention, the distance sensors 10 are provided on the car doors 4. However, the distance sensors 10 are not required to be provided on the car doors 4 as long as the distance from the doorway 8 to the passenger 20 at the landing 6 can be detected. For example, the distance sensors 10 may be provided at the car doorway 3, on the landing doors 7, or at the landing doorway.

In each of the foregoing embodiments of the present invention, the indicators 15 are provided on the car doors 4. However, the indicators 15 are not required to be provided on the car doors 4 as long as the passenger 20 can recognize the indicators 15 from the landing 6. For example, the indicators 15 may be provided on a wall surface of the landing 6 or on the landing doors 7.

The invention claimed is:

1. A door device for an elevator, comprising:

an elevator door for opening and closing a doorway through which an interior of a car communicates with a landing;

a detection device for continuously detecting a movement of a detected object at the landing with respect to the doorway;

a processing device for obtaining a door control command corresponding to information from the detection device and for determining a boarding probability that the detected object is able to board the car;

a door control device for controlling a movement of the elevator door based on the door control command; and a reporting device for reporting boarding probability information calculated by the processing device to the detected object.

2. A door device for an elevator according to claim 1, wherein the door control command includes a door-closing possibility command indicating whether or not a door-closing operation of the elevator door can be performed, and wherein the processing device calculates, as a boarding predictive index, a probability of the detected object boarding the car based on the information from the detection device; and compares the calculated boarding predictive index with a preset threshold to obtain the door-closing possibility command.

3. A door device for an elevator according to claim 1, wherein the door control command includes a door-closing speed command indicating a moving speed of the elevator door during a door-closing operation thereof, and wherein the processing device calculates, as a boarding predictive index, a probability of the detected object boarding the car based on the information from the detection device; and obtains the door-closing speed command based on the calculated boarding predictive index.

4. A door device for an elevator, comprising:

an elevator door for opening/closing a doorway through which an interior of a car communicates with a landing;

a detection device for continuously detecting a movement of a detected object at the landing with respect to the doorway;

a processing device for calculating, based on information from the detection device and information on a door position of the elevator door, a probability of the detected object being inhibited from boarding the car through a door-closing operation of the elevator door as a boarding inhibitory index; and a reporting device for reporting information on the boarding inhibitory index to the detected object.

5. A door device for an elevator according to claim 4, wherein the reporting device has an indicator for continuously indicating at least one of a numerical value corresponding to the boarding inhibitory index, and a color corresponding to the boarding inhibitory index.

6. A door device for an elevator, comprising:

an elevator door for opening/closing a doorway through which an interior of a car communicates with a landing;

a detection device having a plurality of sensors whose detection ranges for detecting a detected object are individually set between the interior of the car and the landing, for detecting a state of the detected object;

a processing device for obtaining a door control command corresponding to the state of the detected object based on pieces of information from each of the sensors;

a door control device for controlling a movement of the elevator door based on the door control command; and a sensor information reporting device for reporting, to the detected object, detecting sensor information for identifying that one of the sensors which detects the detected object.

7. A door device for an elevator according to claim 6, wherein the sensor information reporting device has sensor information indicators provided on the sensors, and wherein only the sensor information indicator, provided on that one of the sensors which detects the detected object, visually changes to report the detecting sensor information to the detected object.

8. A door device for an elevator according to claim 6, wherein the detection ranges overlap with one another, and wherein the processing device compares the pieces of the information from the sensors with one another to determine whether or not the detection device makes an error in detection.

9. A door device for an elevator according to claim 4, wherein the reporting device has an indicator for continuously indicating a sound corresponding to the boarding inhibitory index.

10. A door device for an elevator according to claim 2, wherein the processing device modifies the door-closing possibility command based on the boarding predictive index until the door-closing operation is complete.

* * * * *